US006865826B1

(12) United States Patent
Lakin

(10) Patent No.: US 6,865,826 B1
(45) Date of Patent: Mar. 15, 2005

(54) IMPELLER BLADE FOR SNOWBLOWER

(75) Inventor: Lewis E. Lakin, Lake Forest, IL (US)

(73) Assignee: Lakin General Corporation, Chicago, IL (US)

( * ) Notice: Subject to any disclaimer, the term of this patent is extended or adjusted under 35 U.S.C. 154(b) by 0 days.

(21) Appl. No.: 10/761,860

(22) Filed: Jan. 21, 2004

(51) Int. Cl.[7] ..... E01H 5/00
(52) U.S. Cl. ..... 37/233; 37/259
(58) Field of Search ..... 37/232, 233, 209–213, 37/244, 252; 198/638, 640–642, 657–665, 669–671

(56) References Cited

U.S. PATENT DOCUMENTS

| | | | | |
|---|---|---|---|---|
| 3,805,421 | A * | 4/1974 | Kamlukin et al. | 37/233 |
| 4,203,237 | A | 5/1980 | Enters et al. | |
| 4,322,896 | A * | 4/1982 | Miyazawa et al. | 37/252 |
| 4,531,713 | A | 7/1985 | Balboni | |
| 4,694,594 | A | 9/1987 | Thorud et al. | |
| 4,908,968 | A | 3/1990 | Thorud et al. | |
| 4,916,837 | A | 4/1990 | Olmr et al. | |
| 4,951,403 | A | 8/1990 | Olmr | |
| 4,966,527 | A | 10/1990 | Merz | |
| RE33,726 | E | 10/1991 | Thorud et al. | |
| 5,074,753 | A | 12/1991 | Covington et al. | |
| 5,147,030 | A | 9/1992 | Buschbom | |
| 5,398,431 | A | 3/1995 | Beihoffer et al. | |
| 5,499,904 | A | 3/1996 | Wallace et al. | |
| 5,547,629 | A | 8/1996 | Diesen et al. | |
| 5,758,436 | A | 6/1998 | Harms | |
| 5,939,007 | A | 8/1999 | Iszczyszyn et al. | |
| 5,966,846 | A | 10/1999 | Harms et al. | |
| 6,327,798 | B1 | 12/2001 | Sakai et al. | |
| 6,470,602 | B2 | 10/2002 | White, III et al. | |
| 6,613,392 | B2 | 9/2003 | Baldwin et al. | |

* cited by examiner

*Primary Examiner*—Robert E Pezzuto
(74) *Attorney, Agent, or Firm*—Bell Boyd & Lloyd LLC

(57) ABSTRACT

A blade or paddle for use with a snowblower impeller formed from a flexible material. The flexible material includes a plurality of layers of reinforcing material to reinforce the blade and provide greater tensile strength. The working edge of the blade includes a plurality or pattern of indentations, serrations or dimples that provide an improved engagement function of the blade or paddle and the surface of the ground.

26 Claims, 7 Drawing Sheets

IMPELLER BLADE FOR SNOWBLOWER

BACKGROUND OF THE INVENTION

In many areas of the country, wintertime snow removal poses a daunting and often dangerous chore. For persons of advanced age or for those having acute back problems, the required bending, lifting and tossing of snow inherent in shoveling snow can be hazardous to their health. Accordingly, motorized snowthrowers or snowblowers were developed for consumer and commercial use to remove snow from the ground, in part, to reduce the health risk associated with shoveling snow. Motorized snowblowers generally employ a gas engine or electric motor for driving an impeller which picks up and directs the snow away from the snowblower.

One type of snowthrower or snowblower generally includes a body or frame having a housing with a generally open front, a pair of side walls, a rear wall and a discharge chute. The body or frame is conventionally supported by a suitable wheel assembly to enable a person to easily move the snowblower. One type of snowblower utilizes a single powered implement or impeller for picking up and throwing or directing snow through the discharge chute and outwardly away from the snowblower in a desired direction. In this type of snowblower, the impeller is adapted to rotate around a substantially horizontally extending axis and includes one or more radially extending blades or paddles. One such type of snowblower is illustrated in FIG. 3 as further discussed below.

As illustrated in FIGS. 1 and 3, known blades or paddles, such as blade or paddle 10 are formed and suitably sized to engage the ground surface during operation to develop a force for picking up, directing and throwing snow. Blade 10 includes a body 12. The body 12 defines a plurality of apertures 14 which are employed to attach the blade to the impeller in a conventional manner. As the impeller rotates, a designated or working edge of each blade repeatedly engages the ground surface to pick up and direct the snow. One known problem with this configuration is that the repeated engagement of the blades with and across the ground surface causes the blades to rapidly wear. Worn blades can cause the snowblower to become less efficient or ineffective. Moreover, the quicker the blades wear down, the more often the blades need to be replaced and the more costly it is for a person to operate the motorized snowblower.

As generally illustrated in FIG. 2, certain known impeller blades or paddles are formed from a flexible rubber element 16 which includes a single or multiple layers of woven fabric 18 between the elements which function to structurally reinforce the blade. In other words, a fabric layer is centered between two layers of rubber to provide structural support to the impeller blade. One known impeller blade is formed from rubber conveyor belting which includes one centered polyester fabric layer covered by two equal thickness' of SBR rubber. These fibers do not substantially prevent the wear of the blade. Such blades have substantially smooth working edges which cause a greater portion of the blade to repeatedly engage the ground surface. As described above, the greater the portion of the blade that engages the ground surface, the quicker the blade will be worn away and the more often the blade will need to be replaced.

Therefore, a need exists for a structurally reinforced snowblower blade which provides an improved engaging function between the blade and the ground that wears at a substantially slower rate than conventional snowblower blades.

SUMMARY OF THE INVENTION

The present invention provides a blade or paddle for use with a snowblower impeller and a snowblower having a blade. In one embodiment, the blade or paddle is formed from multiple plys of a flexible material or element, such as rubber, to provide enhanced wear characteristics and to have the rigidity necessary for throwing snow. For one embodiment, each layer or ply of the snowblower blade of the present invention has a reinforcing material, such as polyester or nylon fibers, that reinforce the flexible material of the blade to provide greater tensile strength. The flexible material is coupled with or bonded around each fiber of reinforcing material.

In one preferred embodiment, the blade of the present invention includes a plurality of layers or plies of reinforcing material integrated within a plurality of layers of flexible material. The number of reinforcing layers may vary in accordance with the present invention. It should be appreciated that each layer of reinforcing material preferably includes one ply of fibers angled in one direction and at least one other ply of fibers laid on top of or adjacent to the first ply at a substantially non-perpendicular different angle. Each layer of reinforcing material thus includes a plurality of plies of transversely extending fibers or fabric. The engagement or working edge of the body defines a baseline and the fibers extend from the baseline in multiple patterns of acute and obtuse angles rather than perpendicular to the edge.

The multiple plies and the configuration in which the reinforcing material is positioned or layered within each ply in accordance with the present invention causes (when the blade is formed), the working edge of the blade to include a plurality or pattern of indentations, serrations or dimples. This pattern substantially decreases wear of the blade as further discussed below.

In one embodiment, when the blade is formed, for example by die cutting, the flexible material is compressed and each ply and the flexible material extends further than the plurality of reinforcing fibers that lay within that ply and the flexible material. However, since the reinforcing fibers are coupled to or bonded with the flexible material, as the flexible material expands, the fibers will be pulled or stretched along with the expanding flexible material. It should be appreciated that with the different thicknesses of the flexible material and not a lower coefficient of expansion, as the reinforcing fibers are pulled, a greater proportion of the reinforcing fibers, relative to the overall size, are stretched to expand substantially the same distance as the flexible material, when the die cuts through the reinforcing material, a greater length of reinforcing material than the flexible material is cut.

When the flexible material decompresses, the stretched reinforcing fibers (which have actually been cut more than the rubber material) will retract a greater distance than the flexible material to cause a plurality of indentations, serrations or dimples. That is, as described above, as a greater proportion (relative to their overall size) of the reinforcing fibers were stretched than the flexible material and subsequently cut away, less of the reinforcing fibers (proportionate to overall size) remain after the cut. In other words, when the flexible material and the reinforcing fibers retract to their pre-compression state, less of the fibers will remain (in proportion to their overall size) and thus the fibers will retract a greater distance than the flexible material, leaving an uneven edge or surface for each ply of the impeller blade. As described above, as the fibers and flexible material are coupled or bonded to each other, as the fibers retract, portions of the flexible material will retract more than other portions revealing the dimples. The indentations are formed in the flexible material around where the fiber has retracted.

The plurality of dimples provide a decreased amount of surface area for the blade to engage the ground while still performing substantially the same function as a smooth edged blade. When the blade's working edge engages the ground surface to pick up snow, only the non-indented portion of the blade's edge will directly engage the ground surface. That is, without the entire edge of the blade repeatedly engaging the ground surface, the blade's edge will not be worn away as quickly and the blade will not need to be replaced as often. By die cutting a flexible material having multiple plies each with the above described configuration of reinforcing material or fibers, a snowblower blade or paddle with dimpled edges in accordance with the present invention is formed.

In one preferred embodiment, the blade is formed from a vulcanized rubber, such as used fiber reinforced rubber tire or a section of fiber reinforced tire rubber. Vulcanized rubber has been treated with chemicals to improve the physical properties of the rubber and thus prevent the rubber from breaking down. Since the characteristics of vulcanized tire rubber prevent the rubber from being broken down and recycled similar to common plastics, the present invention provides an alternative use for existing used tires. By utilizing vulcanized tire rubber, the present invention provided the additional advantage of preventing the buildup of fiber reinforced tires in landfills.

The impeller blade of the present invention thus provides an improved engaging function between the blade and the ground while also providing additional structural support to the blade for throwing snow.

Additional features and advantages of the present invention are described in, and will be apparent from, the following Detailed Description of the Invention and the figures.

DETAILED DESCRIPTION OF THE INVENTION

Figure 1:
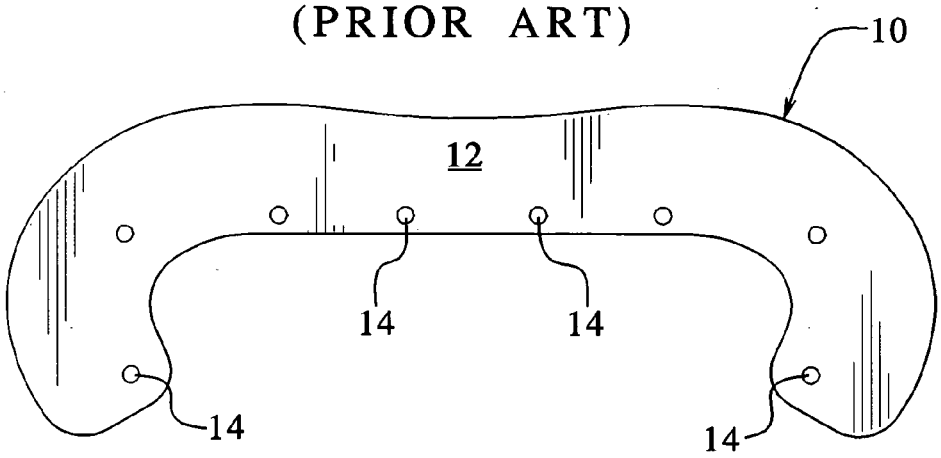
FIG.1 (PRIOR ART)
FIG. 1 is a top plan view of a known impeller blade or paddle before it is bent and connected to a snowblower impeller mechanism.
Figure 3:
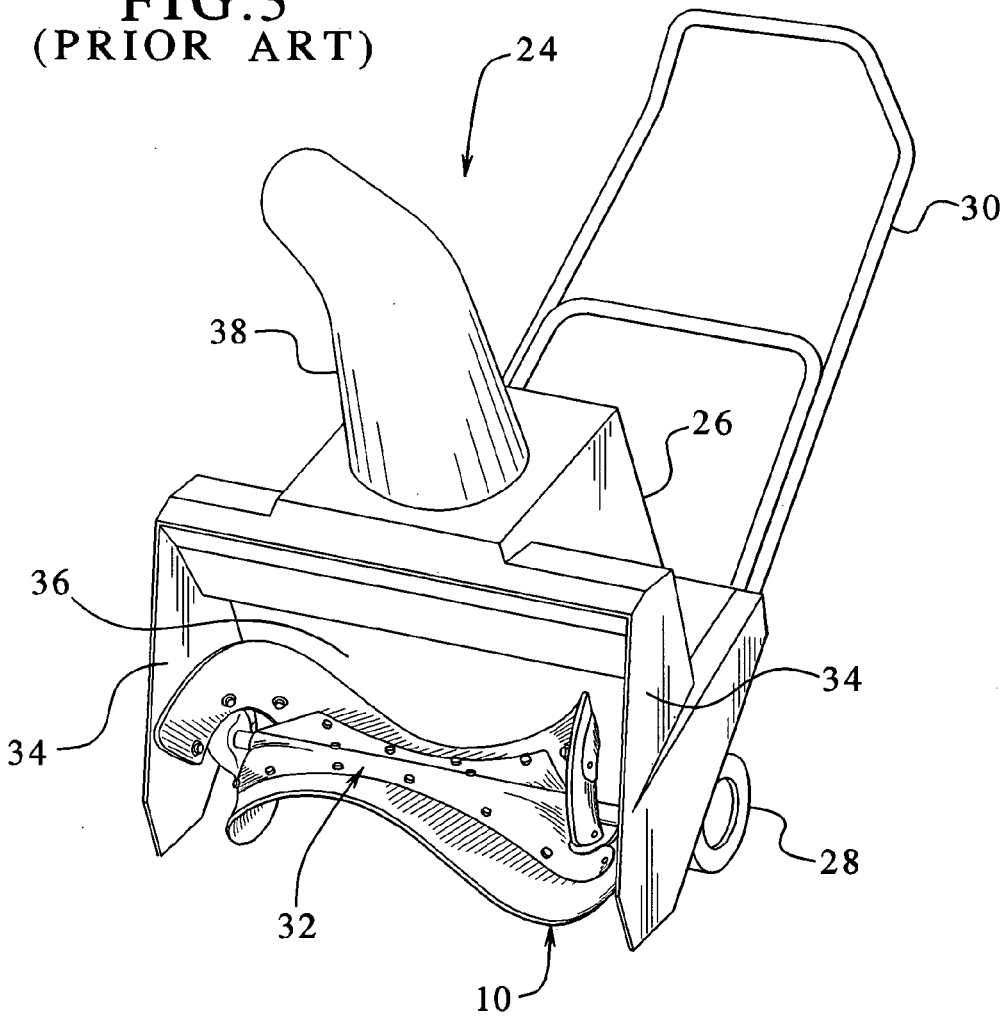
FIG.3 (PRIOR ART)
FIG. 3 is a perspective view of a known single-stage snowblower which can be employed with the present invention.
Figure 2:
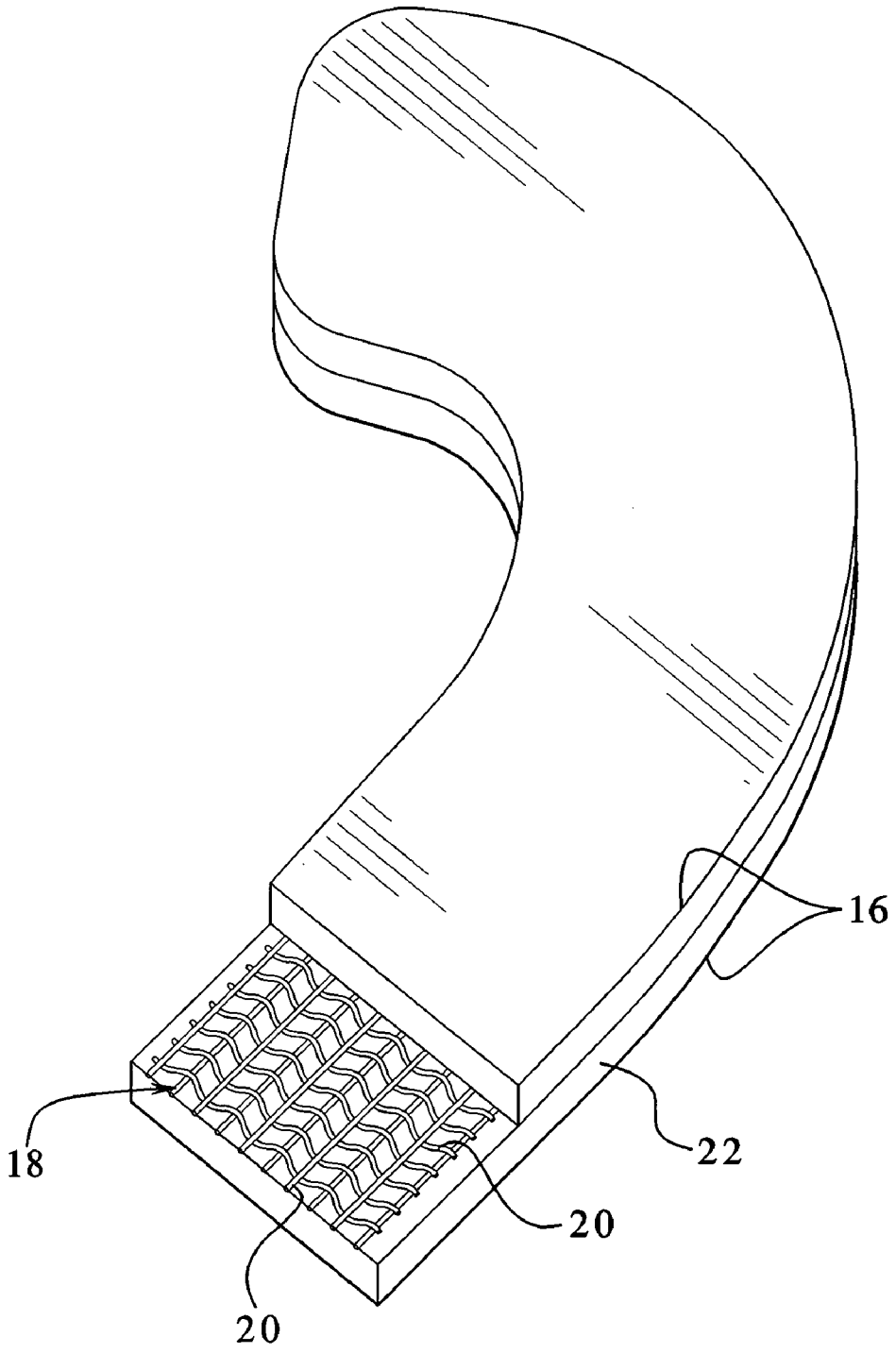
FIG.2 (PRIOR ART)
FIG. 2 is a fragmentally perspective view of a known impeller blade or paddle having a section broken away to illustrate a layer of woven fibers between two layers of flexible material.

Referring now to FIG. 3, the present invention provides a snowblower, such as known snowblower 24 which generally includes a housing 26 supported for rolling along the ground by two spaced apart wheels 28. An upwardly extending handle assembly 30 is secured to the back of the housing and terminates at a height above the ground which is convenient for being gripped by an operator. An internal combustion engine (not shown) or any other suitable actuation mechanism, is mounted to the housing and is coupled by belts and pulleys, chains or any other suitable drive train mechanism to an impeller 32. The handle assembly enables the operator to maneuver the snowblower and to push it forwardly, along with any self-propelling action provided by the impeller.

The housing includes an open front portion in which the impeller is housed for contacting the snow. The front portion includes two side walls 34 and an impeller chamber 36, through which the snow picked up by the impeller is thrown upwardly into and through an adjustable discharge chute 38 which directs the snow forwardly or laterally away from the snowblower. The impeller is configured such that as the snow enters the impeller chamber, the snow in the center of the chamber is propelled upwardly through the discharge chute and the snow at either end of the impeller chamber is moved first axially inwardly toward the center of the impeller and then upwardly through the discharge chute. It should be appreciated that while this embodiment describes only one type of snowblower, any suitable type of snowblower or snow thrower may be employed in accordance with the present invention.

Figure 4:
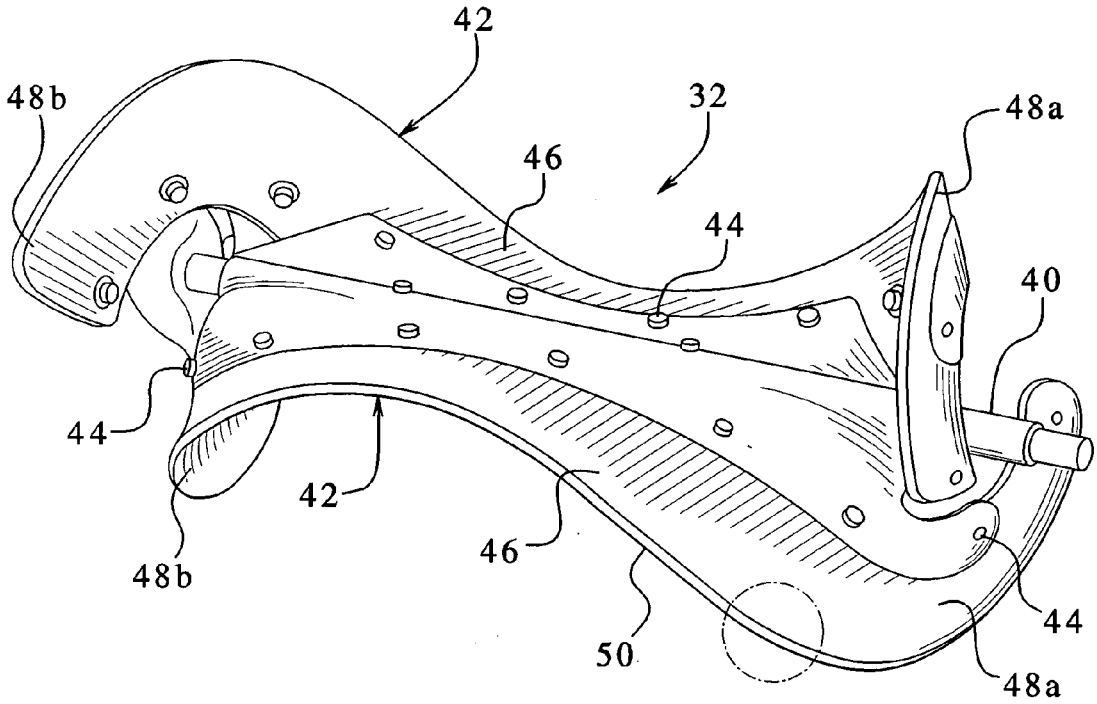
FIG. 4 is a perspective view of an impeller blade or paddle of one embodiment of the present invention attached to the impeller of one type of snowblower.

Referring now to FIG. 4, in one embodiment, the impeller 32 is supported for rotation within the housing and rotates about a substantially horizontal rotational axis. That is, the impeller is mounted on or otherwise suitably attached to a shaft 40 that extends along such axis and that is suitably coupled with the engine. In this embodiment, the impeller includes two outwardly extending paddles or blades 42 which are offset approximately 180° from each other around the circumference of the impeller. In other embodiments, any suitable number of outwardly extending paddles may be implemented in accordance with the present invention. At least one and preferably a plurality of blade holding members 44 are employed to attach the impeller blade or paddle to the structure of the impeller.

As illustrated in FIG. 4, in one embodiment, each paddle or blade includes a body with a relatively long, center snowthrowing section 46 and two relatively short end sections 48*a* and 48*b*. It should be appreciated that any suitable size or shaped blade may be employed in accordance with the present invention. The body defines at least one engaging or working edge 50 that is adapted to engage the ground surface.

Figure 5:
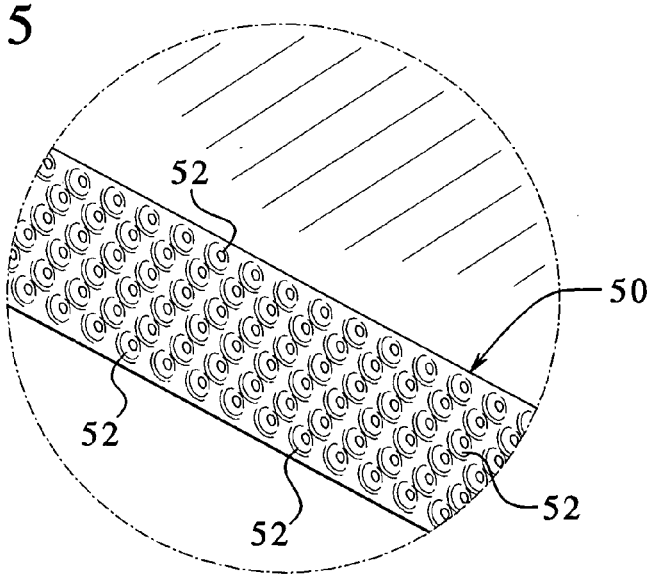
FIG. 5 is an enlarged fragmentary perspective view of the working edge of the impeller blade or paddle of FIG. 4, illustrating the plurality of indentions formed at the working edge of the blade.

As illustrated in FIG. 5 and as discussed in more detail below, the engaging member or edge of each blade includes a plurality or pattern of indentations, serrations or dimples 52 that provides an improved engagement function between the blade and the ground surface.

Figure 6:
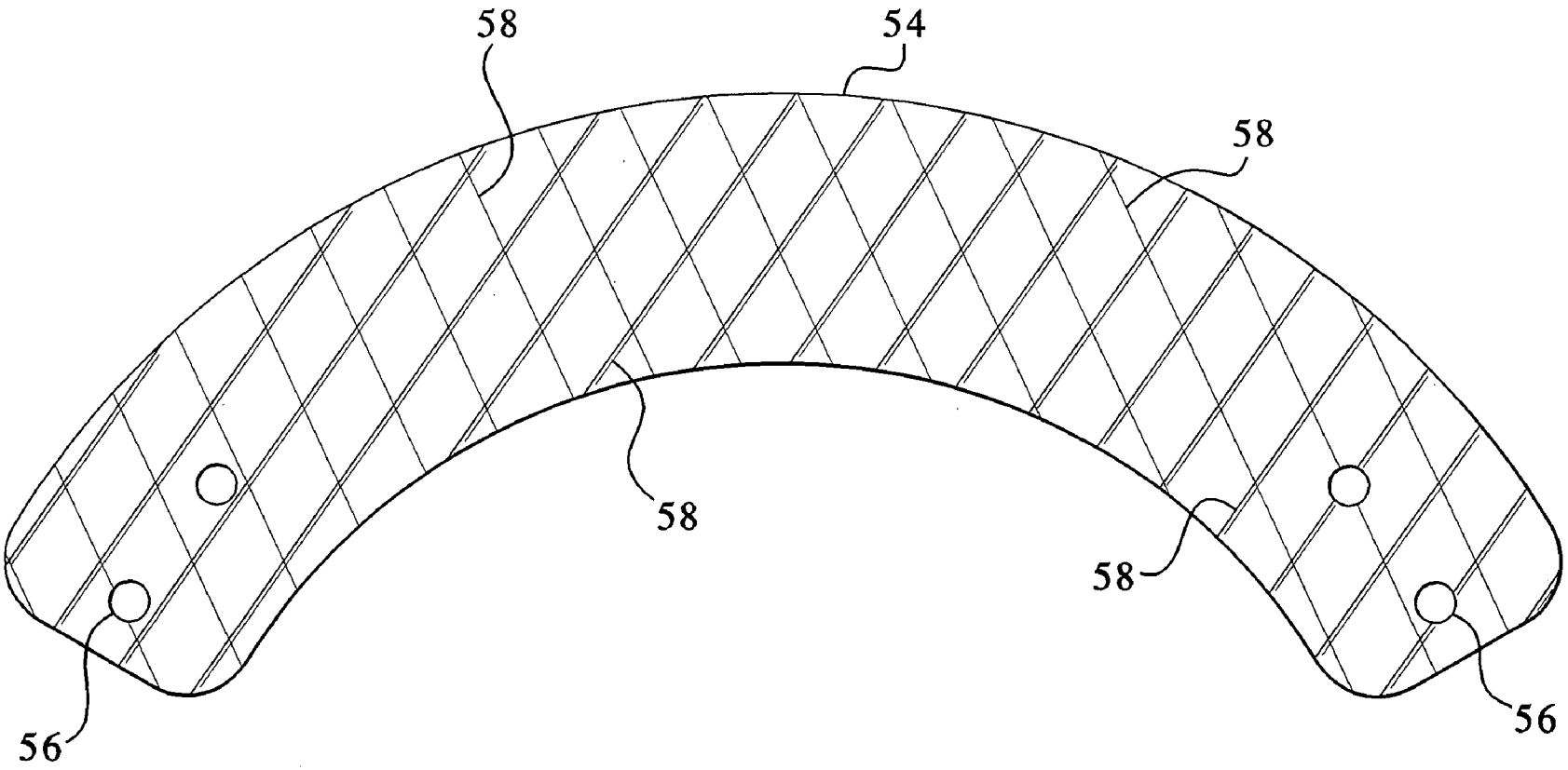
FIG. 6 is a top plan view of an impeller blade of one embodiment of the present invention before it is bent and connected to a substantially parallel snowblower impeller mechanism.

In one embodiment, as illustrated in FIG. 6, the blade of the present invention includes a suitably shaped body 54 which defines a plurality of attachment apertures 56 employed to attach the blade to the structure of the impeller.

In one embodiment, the body of the blade is formed from a plurality of plies of flexible material which each includes one or more internal layers of reinforcing or support material that reinforce the body to provide greater tensile strength. One configuration of the reinforcing materials 58 can be seen protruding from the flexible material in FIG. 6. In one alternative embodiment, the body is formed from a single piece of a flexible material. In one preferred embodiment, the blade or paddle is formed from rubber, such as a section of a used multiple ply fiber reinforced rubber tire. In one such embodiment, the rubber tire includes a plurality of layers of fiber in the respective plies that are each angled at approximately twenty-three degrees to the vertical axis. In another embodiment, the body is formed from a plurality of separate pieces that are attached or otherwise suitably joined together to form the body.

Figure 7:
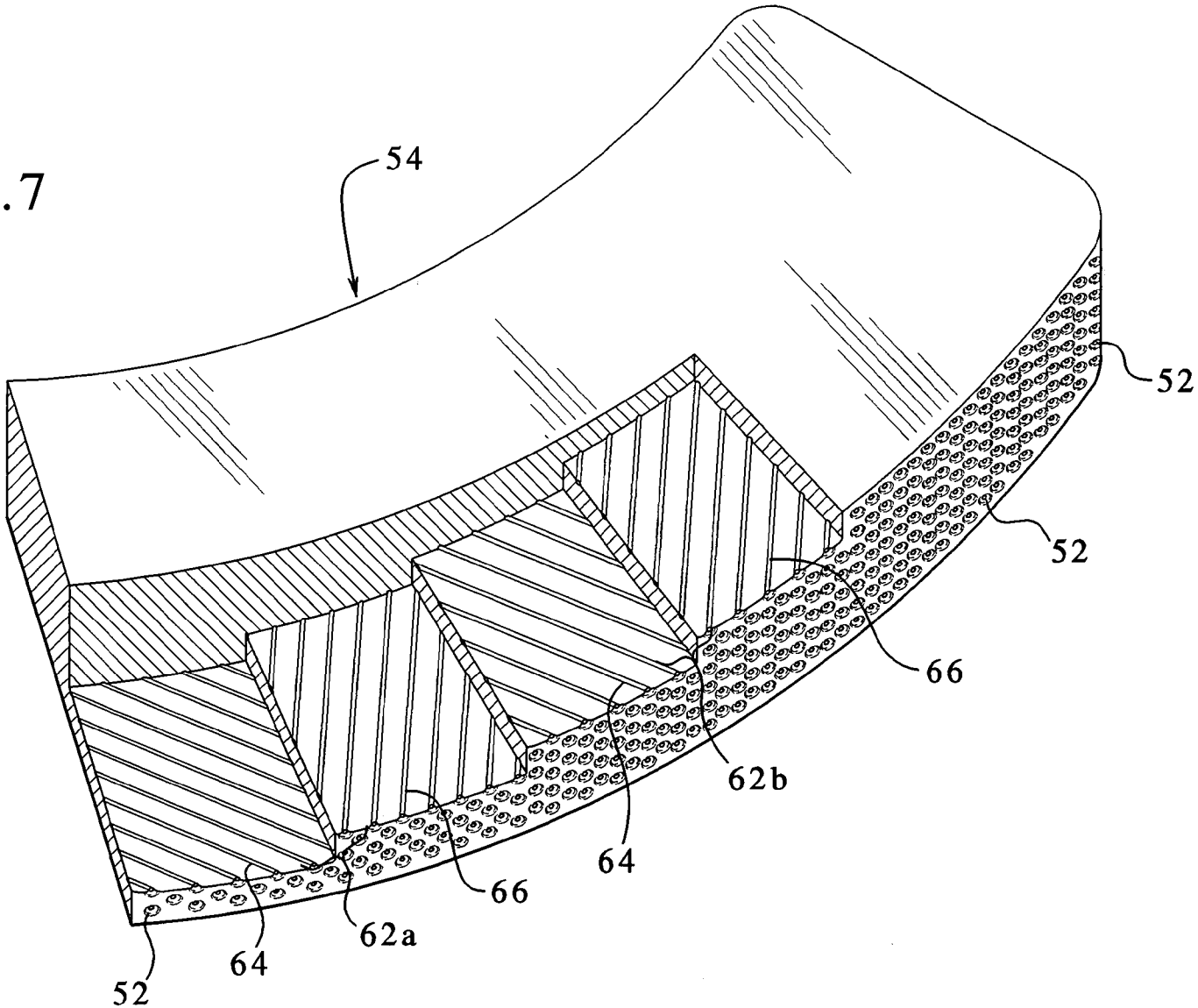
FIG. 7 is a fragmentary perspective view of one embodiment of the impeller blade or paddle of the present invention with a plurality of broken away sections, illustrating a plurality of plies and a plurality and transversely extending fibers in each of the plies layers of flexible material, wherein the fibers extend to the working edge of the blade.

As seen in the cut away portions of FIG. 7, in one embodiment of the present invention, the body 54 includes at least one and preferably a plurality of plies and layers of reinforcing material or fibers, such as nylon or polyester fabric or fibers, that extend throughout the body and in particular, at least one layer in each ply. The layers of reinforcing material 62*a* and 62*b* are coupled to or bonded to the flexible material 60 of the respective plys. As described above, in one embodiment, a first layer of fibers 64 can be layed at an angle in a first direction in one ply and a second layer of fibers 66 layed at an angle in a substantially different, non-perpendicular second direction in another ply. In one such embodiment, the engagement or working edge of the body defines a baseline and the fibers extend from the baseline in multiple patterns of acute and obtuse angles rather than perpendicular to the working edge. It should be appreciated that any suitable number of layers of fibers that extend to the working edge of the blade may be implemented in accordance with the present invention.

As described above, the engaging member or working edge of the body includes a plurality or pattern of dimples, indentations or serrations. These plurality of dimples provide a decreased amount of surface area for the working edge of the blade which engages the ground while still enabling the blade and the working edge of the blade to perform substantially the same function as a smooth working edged blade. The non-indented portion of the blade's working edge will directly engage the ground surface without the entire working edge of the blade repeatedly engaging the ground surface. The blade's working edge will therefore not be worn away as quickly and the blade will not need to be replaced as often.

Figure 8B:
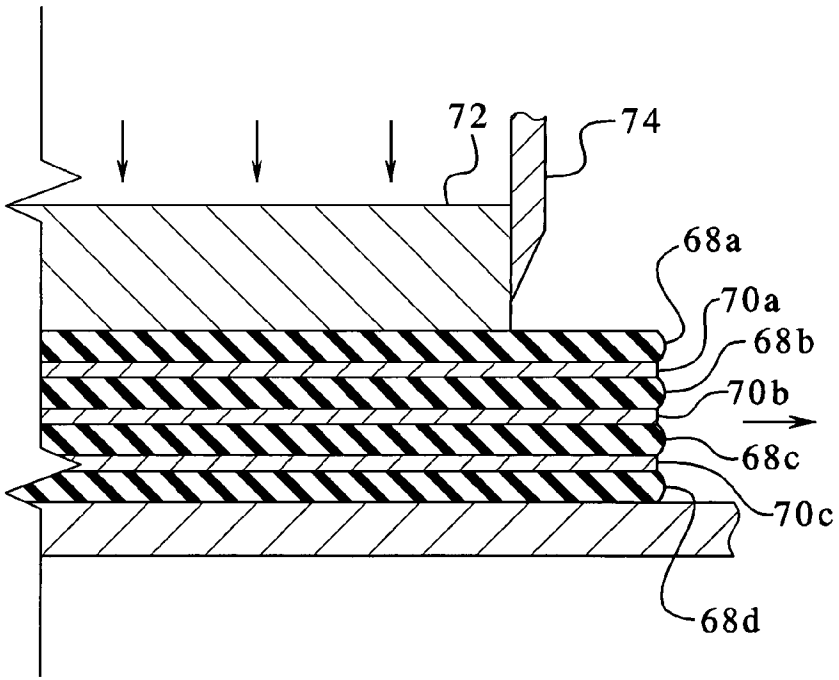
FIGS. 8A, 8B, 8C and 8D are a series of elevational views illustrating one method of forming the impeller blade or paddle of one embodiment of the present invention.
Figure 8A:
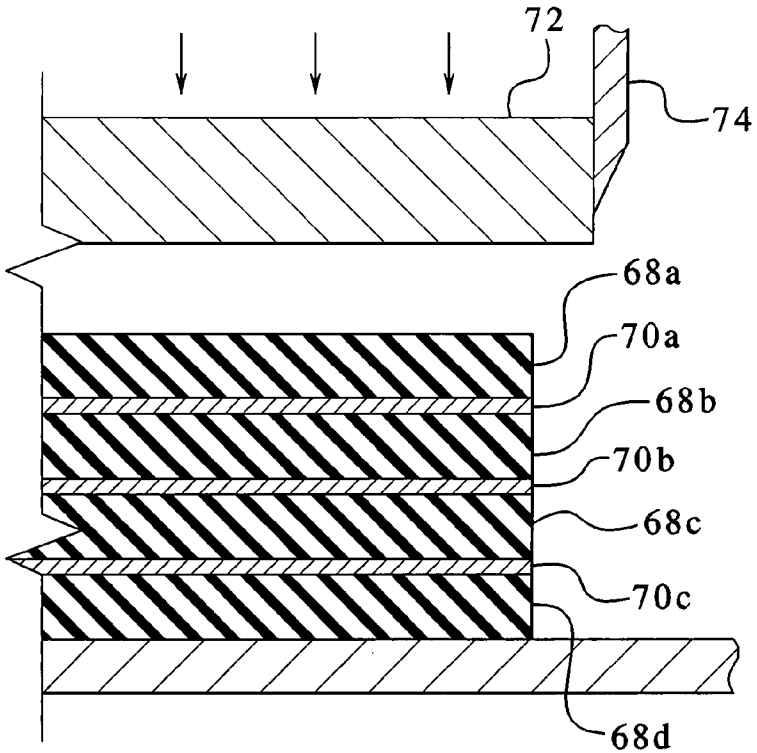

As illustrated in FIGS. 8A, 8B, 8C and 8D, the configuration in which the reinforcing material is positioned or layed within each ply of the flexible material provides that when the blade is formed, the working edge of the blade will include the plurality or pattern of indentations, serrations or dimples. FIG. 8A illustrates a section of the uncut blade material in accordance with one embodiment of the present invention with a plurality of layers of flexible material 68*a*, 68*b*, 68*c* and 68*d*. It should be appreciated that, for purposes of this illustration the plys are separately illustrated and the flexible materials of adjacent ply of the flexible material such as the rubber material illustrated or integral pieces. The layers of reinforcing materials or fibers 70*a*, 70*b* and 70*c* are respectively disposed between the layers of flexible material.

As illustrated in FIGS. 8A and 8B, when the flexible material is compressed such as by a compression member 72 prior to being cut, the flexible material (having a greater coefficient of expansion and having a greater thickness) initially expands a greater distance than the reinforcement fibers as generally illustrated in FIG. 8B. Since the fibers of the reinforcing material are coupled or bonded to the flexible material, as the flexible material expands the reinforcing material or fibers are pulled or stretched along with the expanding flexible material. Without the pulling effect of the expanding flexible material on the reinforcing material, the reinforcing material or fibers would not expand or expand as much upon compression. It should be appreciated that with a lower coefficient of expansion than the flexible material and with a lesser starting thickness, as the reinforcing material is pulled, a greater proportion of the reinforcing material (relative to the overall size of the reinforcing material) is required to stretch the reinforcing material substantially the same distance as the flexible material.

Figure 8D:
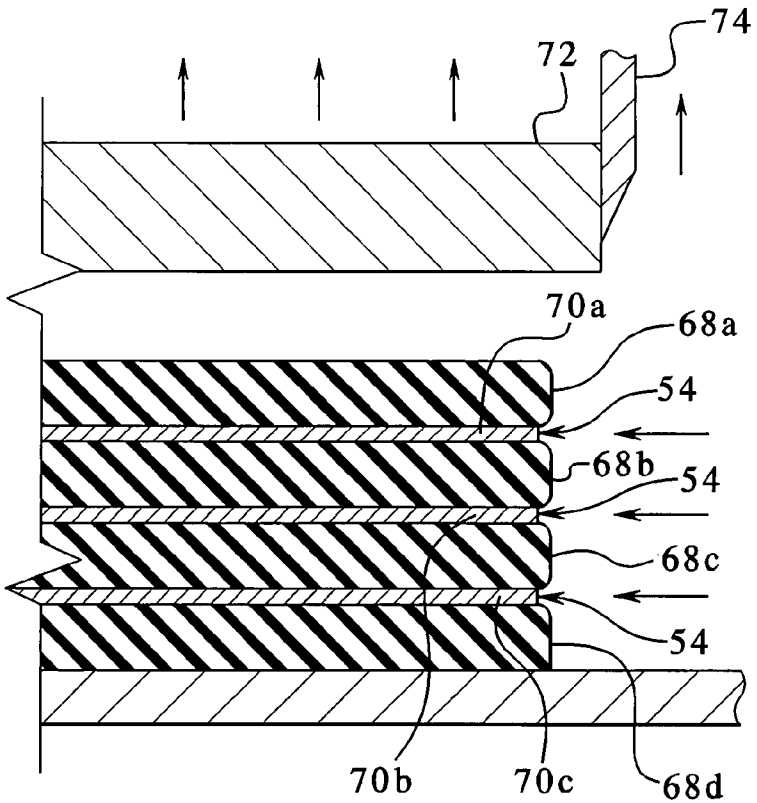
Figure 8C:
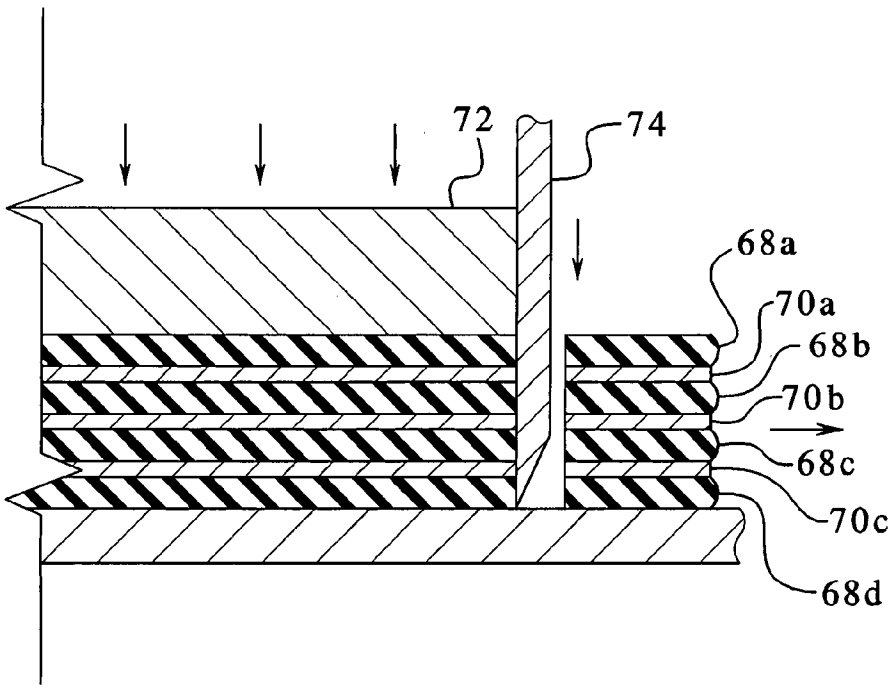

As illustrated in FIG. 8C, a die or other cutting member 74 cuts through the compressed section of reinforced flexible material to form the working edge of the blade.

As illustrated in FIG. 8D, when the section of reinforced flexible material decompresses, the stretched reinforcing material will retract a greater distance than the flexible material to cause the plurality of indentations, serrations or dimples 54. That is, as a greater proportion or length (relative to their overall size) of the reinforcing material is stretched and subsequently cut away than the flexible material, less of the reinforcing material (proportionate to overall size) remains after the cut (i.e., more of the reinforcing material was cut away). In other words, when the flexible material and the reinforcing materials retract to their pre-compression state, less of the flexible material will remain (in proportion to their overall size) and thus the flexible material will retract a greater distance than the flexible material, leaving an uneven working edge or surface of the impeller blade.

Moreover, as illustrated in FIG. 8D, as the reinforcing material and flexible material are integrally coupled or bonded to each other, as the reinforcing material retracts, portions of the flexible material will retract more than other portions to form the dimples of the blade's edge. That is, portions of the flexible material that are directly bonded or coupled with the retracted reinforcement material or fibers will be pulled closer to the retracted reinforcement material than portions of the flexible material that are not in direct contact, thus producing an uneven, indented edge of the flexible material for the working edge of the present invention.

It should be understood that various changes and modifications to the presently preferred embodiments described herein will be apparent to those skilled in the art. Such changes and modifications can be made without departing from the spirit and scope of the present invention and without diminishing its intended advantages. It is therefore intended that such changes and modifications be covered by the appended claims.

The invention is claimed as follows:

1. A snowblower for use on a ground surface, said snowblower comprising:

a housing including an open front portion defined by spaced apart side walls, and a rear wall connected to said side walls;

a discharge chute connected to said housing;

a handle connected to the housing; and an impeller movably coupled to the housing, said impeller including at least one blade having a body formed from a plurality of plies of flexible material, wherein (i) each of a plurality of said plies include an internal layer of reinforcement material, (ii) one layer of reinforcement material in one ply of flexible material is angled in a first direction, (iii) a second layer of reinforcement material in an adjacent ply of flexible material is angled in a second different direction, (iv) said plies define a working edge adapted to engage the ground surface, (v) said working edge defines a plurality of indentations to reduce the amount of surface area of the working edge of the blade that engages the ground surface, and (vi) wherein said indentations are formed by the engagement between said plies and said reinforcement material.

2. The snowblower of claim 1, wherein said impeller includes a plurality of blades that are each adapted to engage the ground surface.

3. The snowblower of claim 1, wherein at least one layer of reinforcement material includes a plurality fibers.

4. The snowblower of claim 3, wherein said fibers are nylon.

5. The snowblower of claim 3, wherein said fibers are polyester.

6. The snowblower of claim 1, wherein each layer of reinforcement material includes a plurality fibers.

7. The snowblower of claim 1, wherein said plies of the body are rubber.

8. The snowblower of claim 7, wherein said rubber plies are formed from a section of tire rubber.

9. The snowblower of claim 1, wherein said blade includes a plurality of apertures for attaching the blade to the impeller.

10. A snowblower for use on a ground surface, said snowblower comprising:

a housing including an open front portion defined by spaced apart side walls, and a rear wall connected to said side walls;

a discharge chute connected to said housing;

a handle connected to the housing; and an impeller movably coupled to the housing, said impeller including at least one blade having a body formed from a plurality of plies of fiber re-enforced tire rubber, wherein:

(i) each of said plies including an internal layer of reinforcement fibers, (ii) said layers of reinforcement fiber material extend in different overlapping directions and are not interwoven, (iii) said plies define a working edge adapted to engage the ground surface, (iv) said working edge defines a plurality of indentations to reduce the amount of surface area of the working edge of the blade that engages the ground surface, and (v) wherein said indentations are formed by the engagement between said plies and said fibers.

11. The snowblower of claim 10, wherein said impeller includes a plurality of blades that are each adapted to engage the ground surface.

12. The snowblower of claim 10, wherein said fibers are nylon.

13. The snowblower of claim 10, wherein said fibers are polyester.

14. The snowblower of claim 10, wherein said blade includes a plurality of apertures for attaching the blade to the impeller.

15. A snowblower impeller blade adapted to be connected to a snowblower, said blade comprising:

a body formed from a plurality of plies of flexible material, wherein:

(i) each of a plurality of said plies includes an internal layer of reinforcement material, (ii) one layer of reinforcement material in one ply of flexible material is angled in a first direction, (iii) a second layer of reinforcement material in an adjacent ply of flexible material is angled in a second different direction, (iv) said plies define a working edge adapted to engage a ground surface when the blade is attached to a snowblower, (v) said working edge defines a plurality of indentations to reduce the amount of surface area of the working edge of the blade that engages the ground surface, and (vi) wherein said indentations are formed by the engagement between said flexible material and said reinforcement material.

16. The snowblower impeller blade of claim 15, wherein each layer of reinforcement material includes a plurality of plies of reinforcement material angled in a plurality of different directions.

17. The snowblower impeller blade of claim 15, wherein said reinforcing material is nylon.

18. The snowblower impeller blade of claim 15, wherein said reinforcing material is polyester.

19. The snowblower impeller blade of claim 15, wherein said flexible material is rubber.

20. The snowblower impeller blade of claim 15, wherein said body is formed from a section of tire rubber.

21. The snowblower impeller blade of claim 15, wherein said body includes a plurality of apertures for attaching the blade to said snowblower.

22. A snowblower impeller blade adapted to be connected to a snowblower, said blade comprising:

a body formed from a plurality of plies of fiber reinforced rubber tire, wherein:

(i) each of said plies includes an internal layer of reinforcement fibers, (ii) said layers of reinforcing fiber extend in different overlapping directions and are not interwoven, (iii) said plies define a working edge adapted to engage a ground surface when the blade is attached to a snowblower, (iv) said working edge defines a plurality of indentations to reduce the amount of surface area of the working edge of the blade that engages the ground surface, and (v) wherein said indentations are formed by the engagement between said plies and said fibers.

23. The snowblower impeller blade of claim 22, wherein said fibers are nylon.

24. The snowblower impeller blade of claim 22, wherein said fibers are polyester.

25. The snowblower impeller blade of claim 22, wherein said blade includes a plurality of apertures for attaching the blade to the impeller.

26. A method of making a snowblower impeller blade adapted to be connected to a snowblower, said method comprising:

(a) compressing a section of fiber reinforced tire rubber, wherein said fibers are not interwoven and wherein said section includes a plurality of plies of tire rubber, each ply having a layer of reinforcement fibers, wherein said compression causes the rubber to expand and said expanded rubber causes said reinforcement fibers to stretch;

(b) cutting said compressed section of flexible material with a cutting member; and (c) allowing said compressed section to decompress after said cutting, wherein said decompression causes said internal layer of reinforcement fibers to retract a greater length than said tire rubber to form a plurality of indentions at a working edge of the blade.

* * * * *